US008919141B2

(12) United States Patent
Li

(10) Patent No.: US 8,919,141 B2
(45) Date of Patent: Dec. 30, 2014

(54) REFRIGERATION EQUIPMENT WITH SLEEVE-TYPE COLLECTION PIPE FOR ARTIFICIAL SKATING RINK

(76) Inventor: Guangjing Li, Wanchai (HK)

( * ) Notice: Subject to any disclaimer, the term of this patent is extended or adjusted under 35 U.S.C. 154(b) by 205 days.

(21) Appl. No.: 13/641,465

(22) PCT Filed: Dec. 31, 2010

(86) PCT No.: PCT/CN2010/080567

§ 371 (c)(1),
(2), (4) Date: Oct. 16, 2012

(87) PCT Pub. No.: WO2012/065341

PCT Pub. Date: May 24, 2012

(65) Prior Publication Data

US 2013/0036758 A1 Feb. 14, 2013

(30) Foreign Application Priority Data

Nov. 15, 2010 (CN) ..... 2010 1 0545060

(51) Int. Cl.
*A63C 19/10* (2006.01)
*F25C 3/02* (2006.01)

(52) U.S. Cl.
CPC ..... *F25C 3/02* (2013.01)
USPC ..... 62/235; 62/434

(58) Field of Classification Search
CPC ..... F25C 3/02; F25C 1/00; F25C 2300/00; F25C 2301/00; E01C 13/01
USPC ..... 62/235, 434, 513, 525, 59
See application file for complete search history.

(56) References Cited

U.S. PATENT DOCUMENTS

| | | | | | |
|---|---|---|---|---|---|
| 1,917,634 | A | * | 7/1933 | Carpenter | 62/235 |
| 3,601,186 | A | | 8/1971 | Smith et al. | |
| 3,910,059 | A | * | 10/1975 | MacCracken | 62/99 |
| 3,919,858 | A | * | 11/1975 | Garland et al. | 62/498 |
| RE29,438 | E | * | 10/1977 | MacCracken et al. | 165/46 |
| 4,194,689 | A | | 3/1980 | Ash | |
| 4,414,821 | A | * | 11/1983 | Jing | 62/235 |
| 4,823,771 | A | * | 4/1989 | Menning | 126/563 |
| 4,979,373 | A | * | 12/1990 | Huppee | 62/235 |
| 5,052,224 | A | * | 10/1991 | Ford et al. | 73/325 |
| 5,702,129 | A | * | 12/1997 | Harrington | 285/45 |

FOREIGN PATENT DOCUMENTS

| | | | |
|---|---|---|---|
| CN | 201897349 | U | 7/2011 |
| GB | 2119496 | A | 11/1983 |
| JP | 2000171137 | A | 6/2000 |

* cited by examiner

*Primary Examiner* — Mohammad M Ali

(57) ABSTRACT

Refrigeration equipment with a sleeve-type collection pipe for an artificial skating rink comprising at least a refrigerating system (3), a refrigeration liquid supplying collection-pipe (1) and a return-gas collection-pipe (2). The return-gas collection-pipe (2) sheathes the refrigeration liquid supplying collection-pipe (1) along length-wise direction. The refrigeration system (3) is provided with a liquid supplying main pipe (41) and a return-gas main pipe (42) sheathed on the liquid supplying main pipe (41). Both ends of the liquid supplying main pipe (41) are respectively connected with the refrigeration liquid supplying collection-pipe (1) and the output end of the refrigeration system (3), and both ends of the return-gas main pipe (42) are respectively connected with the return-gas collection-pipe (2) and the input end of the refrigeration system (3). Multiple groups of circulation pipes (6, 7) arranged in rows are juxtaposed at both sides of the return-gas collection-pipe (2) along the lateral direction.

6 Claims, 4 Drawing Sheets

REFRIGERATION EQUIPMENT WITH SLEEVE-TYPE COLLECTION PIPE FOR ARTIFICIAL SKATING RINK

BACKGROUND OF THE INVENTION

The present invention relates to the technical field of artificial ice-making, in particular to refrigeration equipment with a sleeve-type collection pipe for an artificial skating rink.

As an entertainment sport, skating is widespread, and many competitive events have developed from skating. The traditional ice sports all perform on natural ice, which is formed on the climatic condition of low temperature, which limits the spots to cold regions. Along with the development of science and technology, the competitive events and popular entertainment spots on ice can be promoted in many regions by artificial ice-making technologies.

The applicant put forward a collection-pipe device for distributing refrigerant for an artificial skating rink in the English patent literature (GB2119496) obtained authorization in 1982. This device needs hundreds of tee components for connecting the circulation pipes and the refrigeration collection-pipe, wherein a liquid supplying jet pipe, which is bent into 90 degrees, must be arranged in each tee component, and one end of the liquid supplying jet pipe that faces the liquid supplying pipe is sleeved with an annular baffle to separate the inner cavity of the tee component from the liquid supplying pipe. During processing, the tee component is cut with a lathe to form a groove for fixing the annular baffle. This process is relatively complicated: first, it is difficult and imprecise to cut a groove in the inner port of the tee component, and the liquid supplying jet pipe bent at an angle of 90 degrees is molded by cooling and heating, however the inner diameter of the nozzle is easily deformed causing shrinkage to the cross section in this cooling and heating process, such that the homogeneity of the sprayed liquid is affected; second, the operations of welding the annular baffle of the tee component with the tee component and two round weld seams of the nozzle are very difficult, besides obtaining a good-looking product, the weld seams need cutting and shaping with the lathe for a second time after welding;

Third, after being cut and welded several times, the tee component becomes fragile, so the refrigerant leaks out easily during the leakage check procedure because of the change of the texture; fourth, the liquid outlet and the return air port of the tee component are close to the ice-making collection-pipe and are difficult to weld, and the use of a welding clamp is very inconvenient, so the welding construction is difficult; and fifth, the tee component is of a certain height, and the whole ice-making collection-pipe device has a great vertical dimension such that the thermal insulation material layer at the bottom of the sleeved collection-pipe is thin, and the sleeved collection-pipe performs cold transmission on the lower part of the reinforced concrete to cause condensation.

BRIEF SUMMARY OF THE INVENTION

To overcome the defects of the prior art, the objective of the present invention is to provide refrigeration equipment with a sleeve-type collection pipe for an artificial skating rink. The equipment is simple to process and convenient to operate, reduces the length of the branch circuit by 50%, saves more electricity during running and has a more uniform ice-making effect.

To fulfill the abovementioned objective, the present invention adopts the following technical scheme:

Refrigeration equipment with a sleeve-type collection pipe for an artificial skating rink is provided, which at least comprises a refrigeration system, a refrigeration liquid supplying collection-pipe and a return-gas collection-pipe; the return-gas collection-pipe sheathes the refrigeration liquid supplying collection-pipe along the length direction. The refrigeration system is provided with a main liquid-supplying pipe and a return-gas main pipe sheathed thereon; both ends of the liquid supplying main pipe are respectively connected with the refrigeration liquid supplying collection-pipe and the output end of the refrigeration system, and both ends of the return-gas main pipe are respectively connected with the return-gas collection-pipe and the input end of the refrigeration system; multiple groups of circulation pipes arranged in rows are juxtaposed at both sides of the return-gas collection-pipe along the lateral direction; a first elbow connector is arranged between the liquid supplying end of the circulation pipe and the return-gas collection-pipe, and a second elbow connector is arranged between the return-gas end of the circulation pipe and the return-gas collection pipe; a liquid refrigerant jet pipe is set between the first elbow connector and the refrigeration liquid supplying collection-pipe for communicating the two, and a return-gas hole is provided on the return-gas collection-pipe where it connects the second elbow connector.

The end ports of said first elbow connector and said second elbow connector that are connected with the circulation pipe respectively face the same side of said return-gas collection-pipe and are parallel to each other; and bending angles of said first elbow connector and said second elbow connector both are 135 degrees.

Three support plates are arranged between the outer wall of the refrigeration liquid supplying collection-pipe and the inner wall of the return-gas collection-pipe, and the included angle between two adjacent support plates is 120 degrees.

The outer wall of the return-gas collection-pipe is provided with a thermal insulation layer.

The refrigeration system is a cabinet-type one-piece ice-making machine set or ice-making room.

The two ends of the return-gas collection-pipe and the refrigeration liquid supplying collection-pipe are respectively closed with a closure plate.

The refrigeration equipment with a sleeve-type collection pipe for an artificial skating rink in the invention has the following beneficial effects:

1. The complicated processing procedures of tee components are saved; processing, installation, and welding of the collection-pipes are convenient; the elbows of the collection-pipes are prevented from leaking;

2. The small-caliber nozzle is linearly shaped, is at an angle of 45 degrees to the elbow of the ice-making collection-pipe at the field of the skating rink and therefore is easy to dredge when found to be blocked;

3. The bottom of the ice-making collection-pipe is located at a high position, which can thicken the upper thermal insulation layer of the reinforced concrete, reduce cold transmission, and avoid condensation of the lower part of the concrete;

4. The branch circuit is short; refrigeration is quick; and the ice is more uniform.

DETAILED DESCRIPTION OF THE INVENTION

The following are detailed descriptions of the refrigeration equipment with a sleeve-type collection pipe for an artificial skating rink with the reference of the attached drawings and embodiments, thus more clearly stating the technical concept claimed to be protected by the invention.

Figure 1:
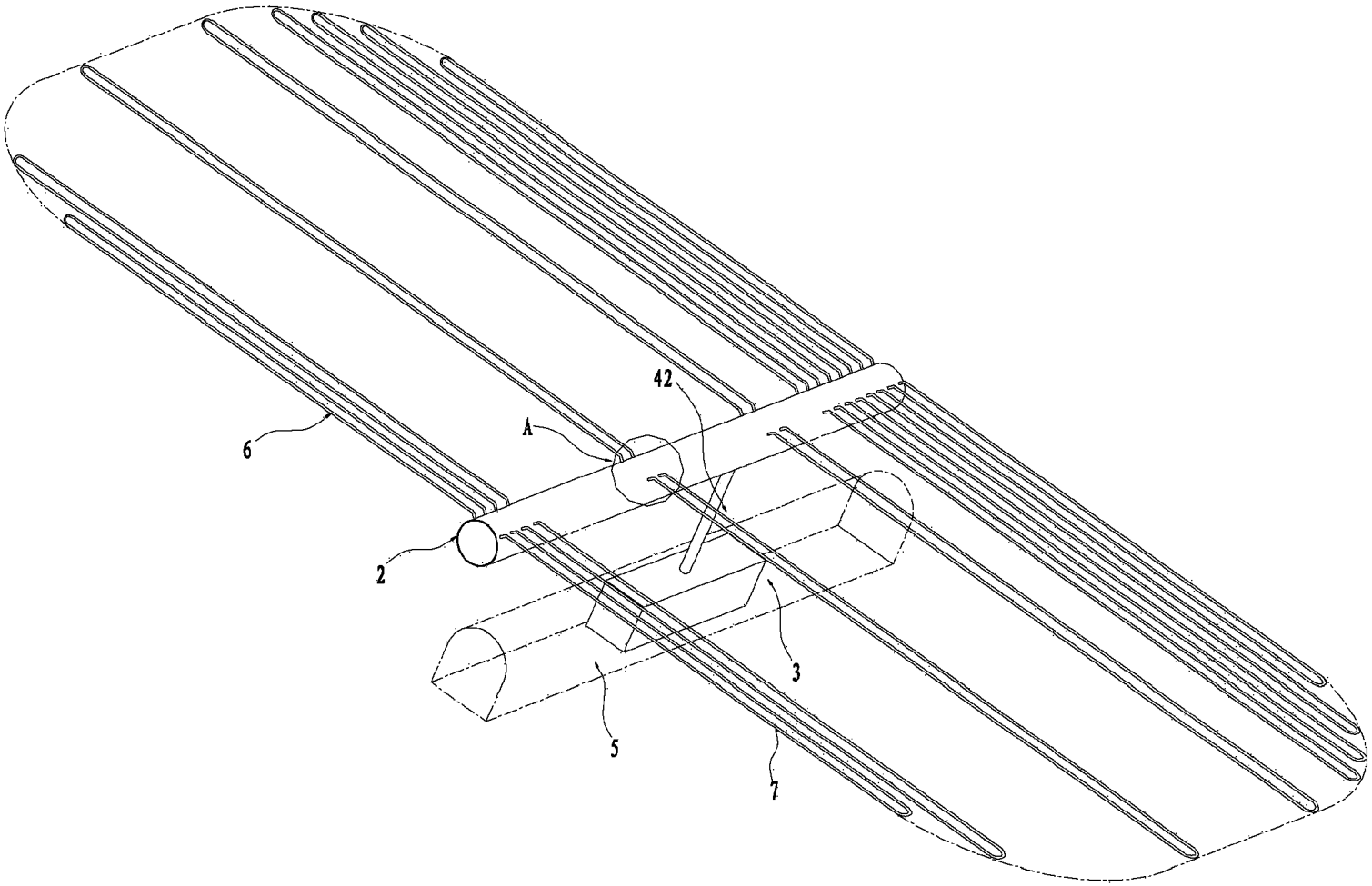
FIG. 1 illustrates a structure view of refrigeration equipment with a sleeve-type collection pipe for an artificial skating rink.
Figure 2:
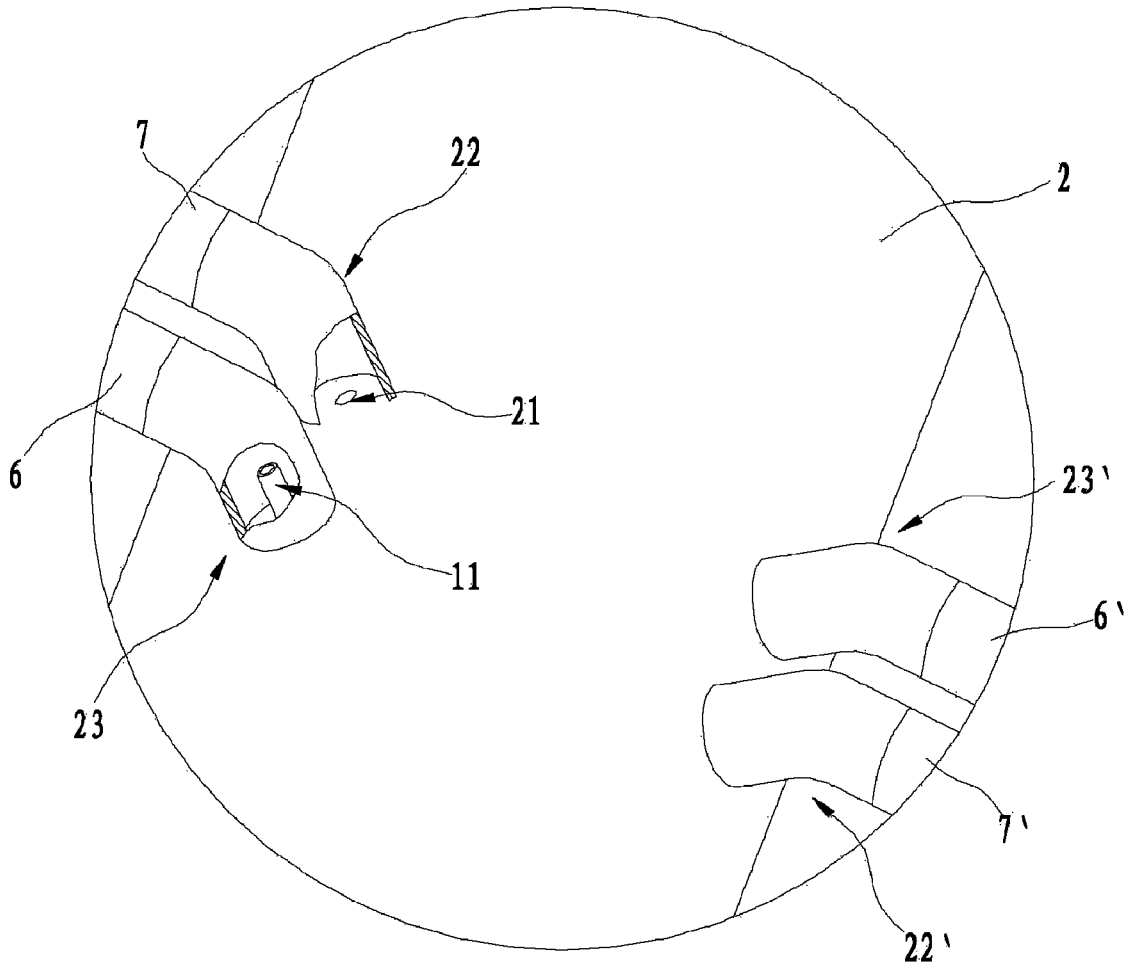
FIG. 2 illustrate an enlarged view of a location marked "A" in FIG. 1.
Figure 3:
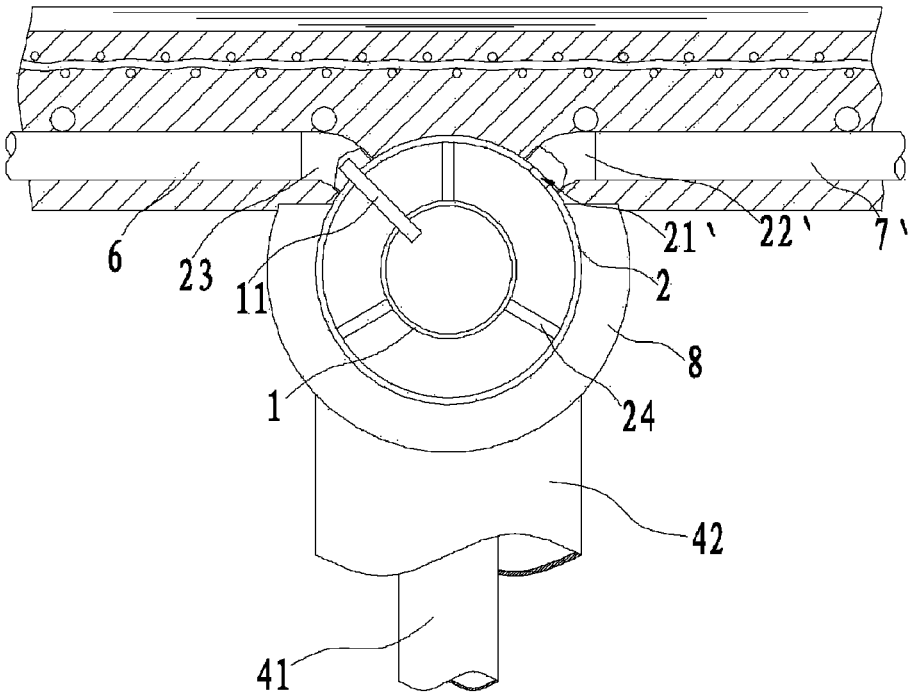
FIG. 3 is a sectional view of FIG. 1.

FIGS. 1, 2 and 3 illustrate a refrigeration equipment with a sleeve-type collection pipe for an artificial skating rink of the invention. The equipment is installed below the ice ground of the skating rink. A trench 5 is arranged along the width direction of the skating rink; the middle part of the trench 5 is provided with a cabinet-type one-piece ice-making set 3; the upper part of the cabinet-type one-piece ice-making set 3 is provided with a refrigerant liquid output end and a refrigerant steam input end; the upper part of the trench 5 is provided with a return-gas collection-pipe 2 which is in parallel to the trench 5; the interior of the trench 5 is sleeved with a refrigeration liquid supplying collection-pipe 1 along the length direction; the cabinet-type one-piece ice-making set 3 is located directly under or on one side of the middle part of the return-gas collection-pipe 2; a return-gas main pipe 42 and a liquid supplying main pipe 41 are arranged between the cabinet-type one-piece ice-making set 3 and the return-gas collection-pipe 2; one end of the return-gas main pipe 42 is connected with and connected to the cavity of the return-gas collection-pipe 2, while the other end is connected with and connected to the return air input end of the cabinet-type one-piece ice-making set 3; one end of the liquid supplying main pipe 41 penetrates through the return-gas main pipe 2 to be connected with and connected to the cavity of the refrigeration liquid supplying collection-pipe 1, while the other end is connected with the refrigerant liquid output end of the cabinet-type one-piece ice-making set 3. Besides, the return-gas collection-pipe 2 is wrapped with a thermal insulation layer 8 to prevent heat transmission between the equipment and the outside.

Of course, according to the known technical knowledge, the cabinet-type one-piece ice-making machine set can be replaced by other refrigerating equipment, such as a nearby refrigerating room, etc.

Figure 4:
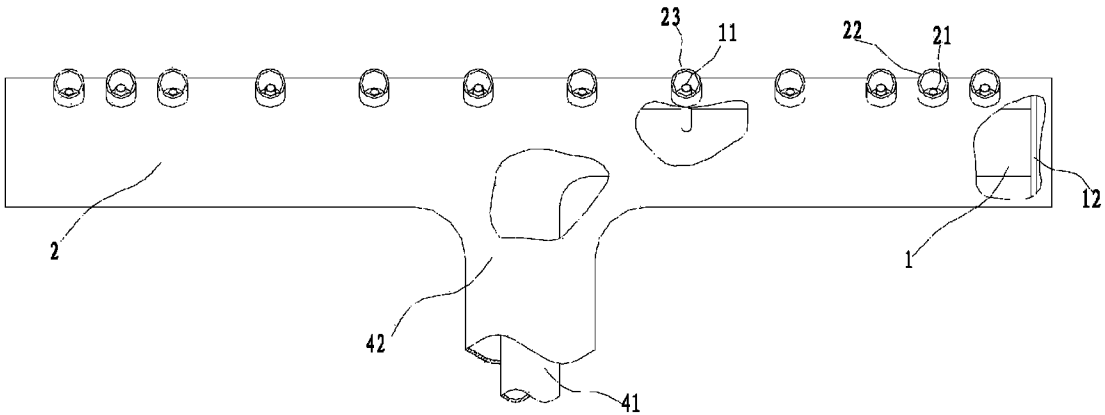
FIG. 4 is a structure view of a return-gas collection-pipe and a refrigeration liquid supplying collection-pipe shown in FIG. 3.

Further, as shown in FIGS. 2, 3 and 4, a reinforced concrete layer is laid below the ice surface of the whole skating rink; many groups of circulation pipes are laid below the reinforced concrete layer; the two end ports of each group of circulation pipe are respectively welded on the same side of the upper part of the outer surface of the return-gas collection-pipe 2; specifically, the upper part of the outer surface of the return-gas collection-pipe 2 is respectively welded with elbows 22 and 23 on the same side; the two elbows have the same structure and the same bending angle of 135 degrees and are arrayed along the length direction of the return-gas collection-pipe 2; the lower ends of the two elbows are welded on the outer surface of the return-gas collection-pipe 2; the included angles between the central axes of the lower ports of the two elbows 22 and 23 and the horizontal direction are 45 degrees, and the upper ports of the two elbows face the same side of the return-gas collection-pipe 2 and are jointed with the two end ports of the circulation pipe by welding respectively.

The lower end of the elbow 23 and the refrigeration liquid supplying collection-pipe 1 are connected with a liquid refrigerant jet pipe 11 there-between; the liquid refrigerant jet pipe 11 is coaxial with the lower end of the elbow 23; the upper end of the liquid refrigerant jet pipe 11 penetrates through a through-hole preset on the wall of the return-gas collection-pipe 2 and is connected with and welded in the elbow 23, and the lower end of the liquid refrigerant jet pipe 11 penetrates through the wall of the refrigeration liquid supplying collection-pipe 1 to be connected with the cavity of the refrigeration liquid supplying collection-pipe 1. A return-gas hole 21 is formed on the return-gas collection-pipe 2 in a range surrounded by the lower port of the elbow 22. One end of the circulation pipe is a liquid supplying pipe 6, while the other end is a return-gas pipe 7; the one welded with the upper port of the elbow 23 is the liquid supplying pipe 6; the one connected with the upper port of the elbow 22 is the return-gas pipe 7; and such structure forms a sets of refrigeration circulating units. The low-temperature liquid generated by the cabinet-type one-piece ice-making unit 3 during working is transmitted into the refrigeration liquid supplying collection-pipe 1 via the liquid supplying main pipe 41, and then injected into the liquid supplying pipe 6 via the small-caliber liquid refrigerant jet pipe 11 to exchange heat with the ice ground of the skating rink; and the low-temperature liquid changes into vapor after absorbing heat, and then is sucked into a cabinet-type one-piece ice-making unit 3 via the return-gas pipe 7, the return-gas hole 21, the return-gas collection-pipe 2 and the return-gas main pipe 42 to further perform refrigeration and circulation.

The above structure forms a set of circulating units. The elbows 22 and 23 are respectively located on the left side of the return-gas collection-pipe 2, and a plurality of elbows 22, 23 are arrayed on this side along the length direction; correspondingly, a plurality of elbows 22, 23 are arranged on the right side of the circulating collection-pipe 2, wherein the elbow 22 is provided with a return-gas hole 21 in side, while the elbow 23 is provided with a liquid refrigerant jet pipe (not shown in the figure) inside; besides, the elbow 23 and the elbow 22 are distributed symmetrically, while the elbow 22 and the elbow 23 are also distributed symmetrically. The upper port of the elbow 22 is connected with the return-gas pipe 7', while the elbow 23 is connected with the liquid supplying pipe 6; and thus, the two elbow 23 and the elbow 22 on the same cross section of the return-gas collection-pipe 2 the symmetrically distributed in a V shape.

Further as shown in FIG. 4, the flow directions of the refrigerant and air of two adjacent refrigeration cooling units are opposite, which means that, on the same side of the return-gas collection-pipe 2, the liquid refrigerant jet pipe 11 and the return-gas hole 21 are installed at an interval, and the plurality of elbows are arrayed in parallel along the length direction of the return-gas collection-pipe 2. The two ends of the refrigeration liquid supplying collection-pipe 1 and the return-gas collection-pipe 2 are respectively covered with a closure plate 12 to prevent the refrigerant and air from leaking.

Besides, to strengthen the whole equipment, the inventor designs three support plates 24 between the inner wall of the return-gas collection-pipe 2 and the outer wall of the refrigeration liquid supplying collection-pipe 1, wherein the included angle between two support plates 24 is 120 degrees.

Those skilled in this field are able to provide all kinds of changes and deformation which shall be within the protection scope of the claims of the present invention according to the mentioned technical solutions and conception.

What is claimed is:

1. Refrigeration equipment with a sleeve-type collection pipe for an artificial skating rink, which at least comprises a refrigeration system, a refrigeration liquid supplying collection-pipe, and a return-gas collection-pipe; the return-gas collection-pipe sheathes the refrigeration liquid supplying collection-pipe along the length direction; the refrigeration system is provided with a liquid supplying main pipe and a return gas main pipe sheathed thereon; both ends of the liquid supplying main pipe are respectively connected with the refrigeration liquid supplying collection-pipe and an output end of the refrigeration system, and both ends of the return-gas main pipe are respectively connected with the return-gas collection-pipe and an input end of the refrigeration system; multiple groups of circulation pipes arranged in rows are juxtaposed at both sides of the return-gas collection-pipe along the lateral direction; a first elbow connector is arranged between the liquid supplying end of the circulation pipe and the return-gas collection-pipe, and a second elbow connector is arranged between the return-gas end of the circulation pipe and the return-gas collection pipe; a liquid refrigerant jet pipe is set between the first elbow connector and the refrigeration liquid supplying collection-pipe for communicating the first elbow connector and the refrigeration liquid supplying collection-pipe, and a return-gas hole is provided on the return-gas collection-pipe where it connects the second elbow connector.

2. The refrigeration equipment with a sleeve-type collection pipe for an artificial skating rink according to claim 1, wherein end ports of said first elbow connector and said second elbow connector that are connected with the circulation pipe respectively face the same side of said return-gas collection-pipe and are parallel to each other; and bending angles of said first elbow connector and said second elbow connector are both 135 degrees.

3. The refrigeration equipment with a sleeve-type collection pipe for an artificial skating rink according to claim 2, wherein three support plates are arranged between the outer wall of said refrigeration liquid supplying collection-pipe and the inner wall of said return-gas collection-pipe, and the angle between adjacent two support plates is 120 degrees.

4. The refrigeration equipment with a sleeve-type collection pipe for an artificial skating rink according to claim 2, wherein the outer wall of said return-gas collection pipe is provided with an insulation layer.

5. The refrigeration equipment with a sleeve-type collection pipe for an artificial skating rink according to claim 2, wherein the refrigerating system is a one-piece ice-making room.

6. The refrigeration equipment with a sleeve-type collection pipe for an artificial skating rink according to claim 1, wherein the two ends of said return-gas collection pipe and said refrigeration liquid supplying collection-pipe are provided with closure plates.

* * * * *